US010875317B2

(12) United States Patent
Sohgawa

(10) Patent No.: US 10,875,317 B2
(45) Date of Patent: Dec. 29, 2020

(54) LIQUID TANK, LIQUID CIRCULATION DEVICE, AND LIQUID DISCHARGE APPARATUS

(71) Applicant: Norimasa Sohgawa, Kanagawa (JP)

(72) Inventor: Norimasa Sohgawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/590,119

(22) Filed: Oct. 1, 2019

(65) Prior Publication Data

US 2020/0147973 A1 May 14, 2020

(30) Foreign Application Priority Data

Nov. 12, 2018 (JP) ..... 2018-212095

(51) Int. Cl.
*B41J 2/175* (2006.01)

(52) U.S. Cl.
CPC ..... *B41J 2/17523* (2013.01)

(58) Field of Classification Search
CPC ..... B41J 2/175; B41J 2/17523
See application file for complete search history.

(56) References Cited

U.S. PATENT DOCUMENTS

2005/0104942 A1* 5/2005 Katayama ..... B41J 2/17523 347/86
2006/0274131 A1* 12/2006 Noguchi ..... B41J 2/17523 347/85
2013/0033536 A1 2/2013 Sawase
2013/0222460 A1 8/2013 Sawase
2014/0313254 A1 10/2014 Sohgawa
2015/0242726 A1 8/2015 Sohgawa et al.
2015/0254505 A1 9/2015 Sohgawa et al.
2015/0306878 A1 10/2015 Sawase
2015/0306891 A1 10/2015 Sohgawa et al.
2016/0101629 A1 4/2016 Sawase
(Continued)

FOREIGN PATENT DOCUMENTS

JP 2006-069109 3/2006
JP 2011-201176 10/2011
JP 2014-195982 10/2014

OTHER PUBLICATIONS

U.S. Appl. No. 16/351,182, filed Mar. 12, 2019, Norimasa Sohgawa, et al.

*Primary Examiner* — Lamson D Nguyen
(74) *Attorney, Agent, or Firm* — Duft & Bornsen, PC

(57) ABSTRACT

A liquid tank includes a tank body configured to store a liquid to be supplied to a liquid discharge head, a first container, a second container, a partition dividing an interior of the tank body into the first container and the second container, a communication path disposed in the tank body, the communication path connecting the first container and the second container, a liquid inlet communicating with the first container, a liquid outlet disposed at a position lower than the communication path, the liquid outlet communicating with the second container, a first connection port communicating with the first container, the first connection port disposed lower than the liquid inlet and configured to be connected to a supply port of the liquid discharge head, and a second connection port communicating with the second container, the second connection port disposed at a position lower than the liquid outlet.

11 Claims, 9 Drawing Sheets

(56) References Cited

U.S. PATENT DOCUMENTS

| | | | |
|---|---|---|---|
| 2016/0129693 | A1 | 5/2016 | Moriwaki et al. |
| 2017/0066236 | A1 | 3/2017 | Sohgawa et al. |
| 2017/0129245 | A1 | 5/2017 | Kohda et al. |
| 2018/0134033 | A1 | 5/2018 | Sawase |
| 2018/0272739 | A1 | 9/2018 | Sawase et al. |
| 2018/0290446 | A1 | 10/2018 | Kohda et al. |
| 2019/0270308 | A1 | 9/2019 | Watanabe et al. |
| 2019/0283411 | A1 | 9/2019 | Sohgawa |
| 2019/0283413 | A1 | 9/2019 | Katoh et al. |

* cited by examiner

LIQUID TANK, LIQUID CIRCULATION DEVICE, AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2018-212095, filed on Nov. 12, 2018, in the Japan Patent Office, the entire disclosure of which is incorporated by reference herein.

BACKGROUND

Technical Field

The present disclosure relates to a liquid tank, a liquid circulation device, and a liquid discharge apparatus.

Discussion of the Background Art

Examples of liquid discharge heads (hereinafter also referred to simply as "heads") include flow-through heads (circulation-type heads) each including: a supply channel leading to pressure chambers (individual liquid chambers) communicating with nozzles; a collection channel communicating with the individual liquid chambers; a liquid supply port communicating to the supply channel; and a liquid collection port communicating with the collection channel. There are also circulation-type heads that circulate liquid only a common channel.

For example, a liquid discharge apparatus includes: a head; a first tank; a second tank; a first liquid channel; a second liquid channel; a third liquid channel; a negative pressure provider for making the pressure in the second tank a negative pressure; and a controller that controls the negative pressure provider. The second tank is disposed at a position higher in the vertical direction than the liquid level of the ink stored in the first tank. The controller controls the negative pressure provider to make the pressure in the second tank a negative pressure so that the ink stored in the first tank is moved into the second tank through the first liquid channel, the head, and the second liquid channel.

SUMMARY

A liquid tank includes a tank body configured to store a liquid to be supplied to a liquid discharge head, a first container, a second container, a partition dividing an interior of the tank body into the first container and the second container, a communication path disposed in the tank body, the communication path connecting the first container and the second container, a liquid inlet communicating with the first container, a liquid outlet disposed at a position lower than the communication path, the liquid outlet communicating with the second container, a first connection port communicating with the first container, the first connection port disposed lower than the liquid inlet and configured to be connected to a supply port of the liquid discharge head, and a second connection port communicating with the second container, the second connection port disposed at a position lower than the liquid outlet and configured to be connected to a collection port of the liquid discharge head.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
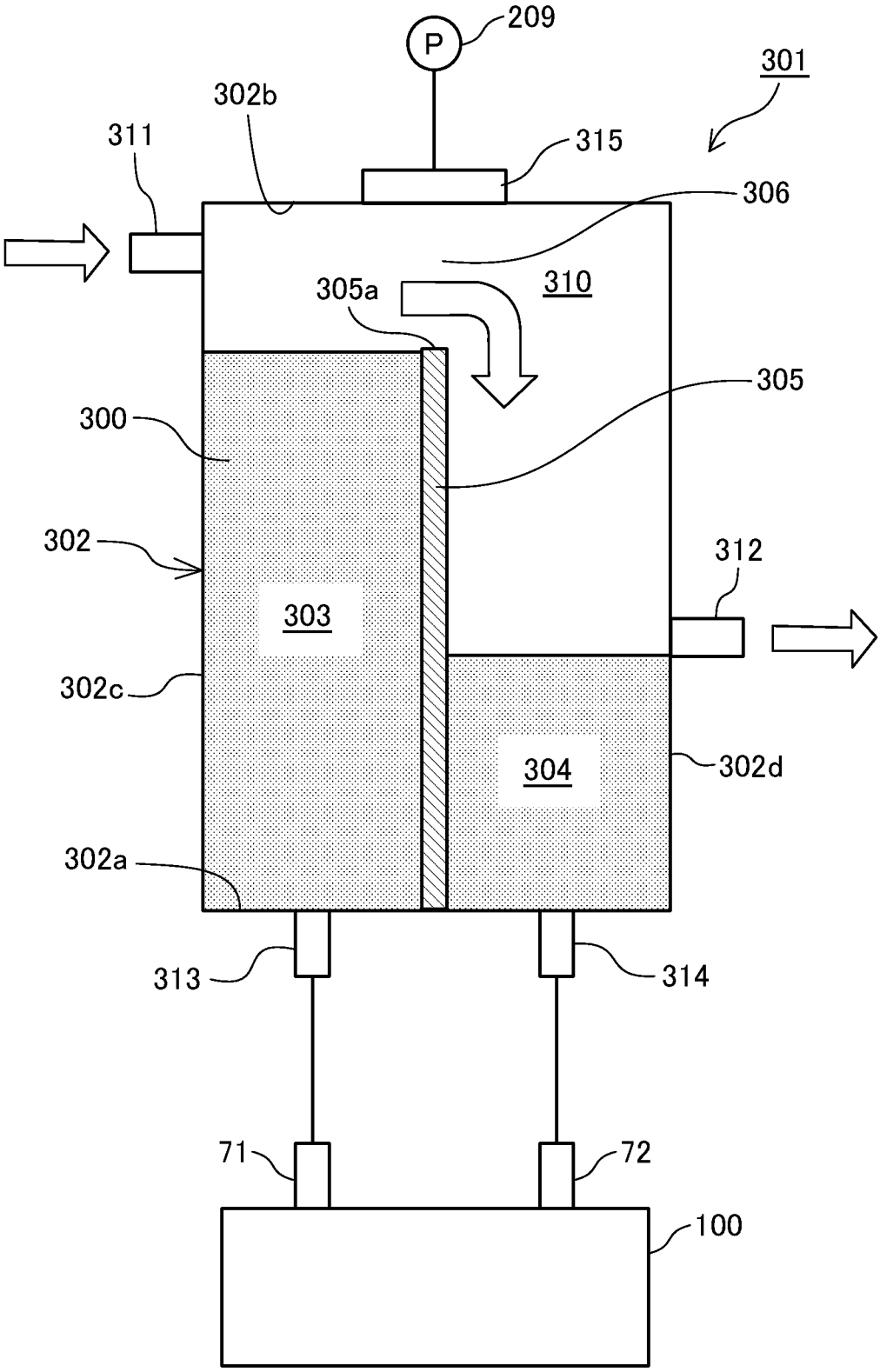
FIG. 1 is an explanatory diagram of a liquid tank according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below. Referring now to FIG. 1, a first embodiment of the present disclosure is described. FIG. 1 is an explanatory diagram of a liquid tank according to the present embodiment.

A liquid tank 301 includes a tank body 302 that stores a liquid 300, a partition 305 that divides the inside of the tank body 302 into a first container 303 and a second container 304, and a communication path 306 that connects the first container 303 and the second container 304.

In the present embodiment, the partition 305 rinsing (standing) from the bottom surface 302*a* in the tank body 302 is designed to have a height that does not reach the top surface 302*b*, so that the communication path 306 is formed.

However, the communication path 306 is not necessarily formed in this manner. For example, the partition 305 may stand to reach the top surface 302*b* in the tank body 302, and cutout portions or through holes may be formed in the partition 305, to form the communication path 306 that connects the first container 303 and the second container 304.

Thus, the partition 305 vertically rises from an inner bottom surface 302*a* of the tank body 302 to a position lower than an inner top surface 302*b* of the tank body 302. The communication path 306 is formed between a top end 305*a* of the partition 305 and the inner top surface 302*b* of the tank body 302.

A sidewall surface 302*c* of the tank body 302 has a liquid inlet 311 communicating with the first container 303, and a sidewall surface 302*d* has a liquid outlet 312 communicating with the second container 304. Here, the liquid inlet 311 is disposed at a position higher than the lowest portion of the communication path 306, and the liquid outlet 312 is disposed at a position lower than the lowest portion of the communication path 306.

With this arrangement, when the liquid level of the liquid 300 flowing into the first container 303 becomes higher than the top surface (the communication path 306) of the partition 305, the liquid 300 flows from the first container 303 into the second container 304 as indicated by an arrow.

When the liquid level of the second container 304 becomes higher than the liquid outlet 312, the liquid flows out from the second container 304 (provided that the downstream side of the liquid outlet 312 is not closed).

In this case, the space in which the liquid 300 in the first container 303 and the second container 304 in the tank body 302 is not stored is an air layer 310.

A first connection port 313 to be connected to a liquid discharge head 100 is attached to the first container 303 at a position lower than the liquid inlet 311, and a second connection port 314 to be connected to the liquid discharge head 100 is attached to the second container 304 at a position lower than the liquid outlet 312.

Although the first connection port 313 and the second connection port 314 are formed on the bottom surface 302*a* of the tank body 302 in the present embodiment, the first connection port 313 and the second connection port 314 may be formed on the sidewall surfaces 302*c* and 302*d*, respectively. However, to reduce sedimentation of the sedimentary component contained in the liquid 300 in the first container 303 and the second container 304, the first connection port 313 and the second connection port 314 are preferably formed on the bottom surface 302*a* in the tank body 302.

A third connection port 315 to be connected to a vacuum pump 209 serving as a depressurizing device that reduces the pressure in the tank body 302 is attached to the top surface 302*b* in the tank body 302.

In the liquid tank 301, the liquid level of the first container 303 is higher than the liquid level of the second container 304. Therefore, the liquid tank 301 is disposed at a position higher than a circulation-type head 100. For example, the first connection port 313 is connected to the supply port of a head 100, and the second connection port 314 is connected to the collection port of the head 100.

With this arrangement, the liquid 300 in the first container 303 is supplied to the head 100 by virtue of the water head difference between the liquid tank 301 and the head 100, and the liquid having passed through the head 100 is collected in the second container 304. Thus, the liquid 300 can be supplied and collected (circulated).

Figure 2:
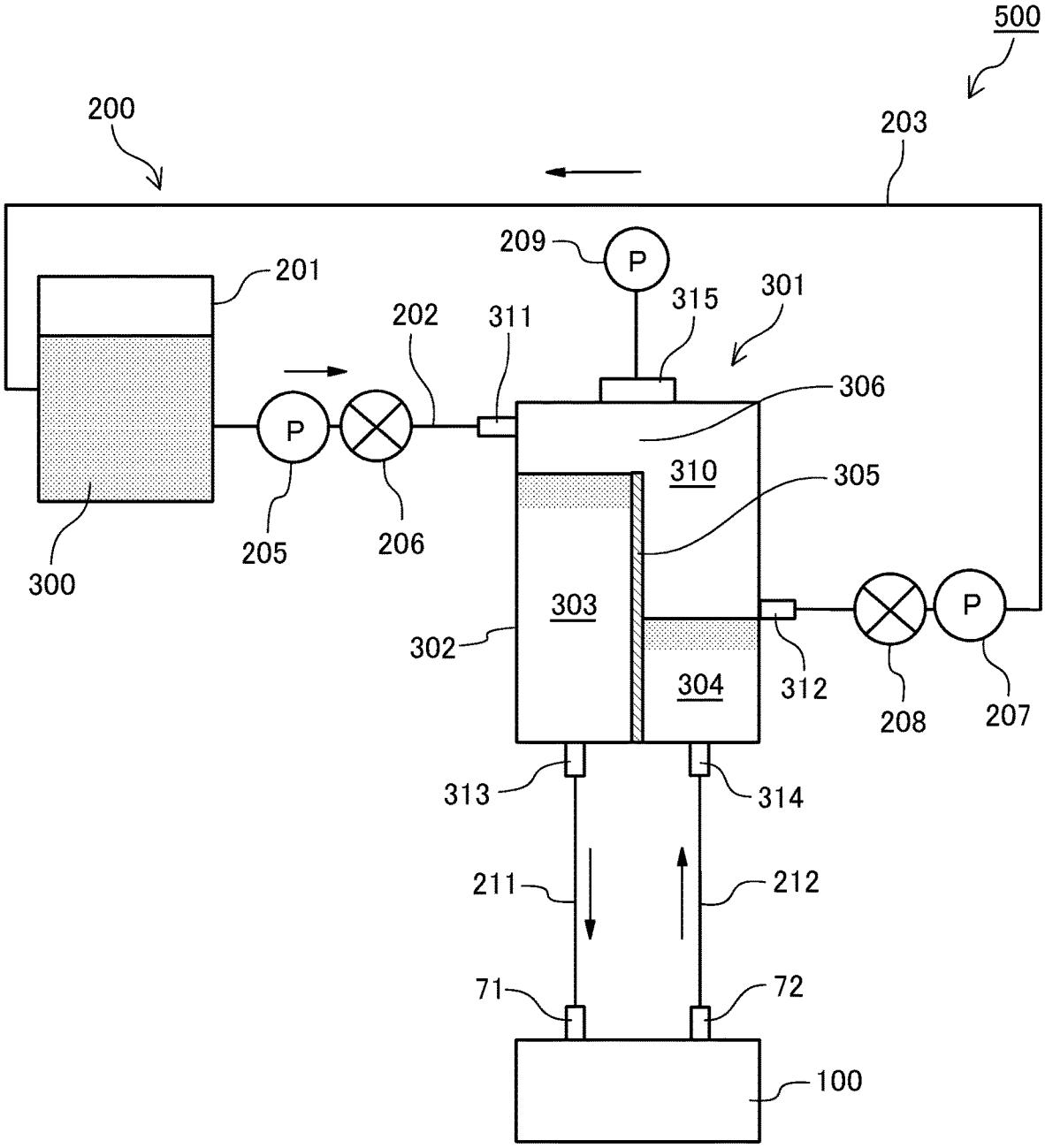
FIG. 2 is an explanatory diagram of a liquid discharge apparatus including a liquid circulation device according to a second embodiment of the present disclosure.

Referring now to FIG. 2, a second embodiment of the present disclosure is described. FIG. 2 is an explanatory diagram of a liquid discharge apparatus including a liquid circulation device according to the present embodiment. The liquid in the containers of a liquid tank is only partially illustrated for the sake of clarity (the same applies to the drawings that follow).

A liquid discharge apparatus 500 includes a head 100 that is a circulation-type liquid discharge head, and a liquid circulation device 200 (also a liquid supply device) that supplies and collects liquid to and from the head 100.

The liquid circulation device 200 includes the liquid tank 301 according to the first embodiment, and a main tank 201 that stores the liquid 300 to be supplied to the liquid tank 301. The liquid circulation device 200 further includes a liquid path 202 that connects the main tank 201 and the liquid inlet 311 of the liquid tank 301, and a liquid path 203 that connects the main tank 201 and the liquid outlet 312 of the liquid tank 301.

In the liquid path 202, a liquid feed pump 205 that is a liquid feeder, and an opening-and-closing valve 206 that opens and closes the liquid path 202 are disposed. In the liquid path 203, a liquid feed pump 207 that is a liquid feeder, and an opening-and-closing valve 208 that opens and closes the liquid path 203 are disposed.

The liquid tank 301 is disposed at a higher position than the circulation-type head 100. The first connection port 313 is connected to a supply port 71 that is the supply port of the head 100 via a liquid path 211, and the second connection port 314 is connected to a collection port 72 that is the collection port of the head 100 via a liquid path 212.

The third connection port 315 of the liquid tank 301 is connected to a vacuum pump 209 that is the depressurizing device that reduces the pressure in the tank body 302.

In the liquid circulation device 200, the liquid 300 in the main tank 201 is supplied to the first container 303 of the liquid tank 301 by the liquid feed pump 205. The liquid 300 in the first container 303 of the liquid tank 301 is supplied to the supply port 71 of the head 100 by virtue of a water head difference, and the liquid 300 that has passed through the head 100 is collected from the collection port 72 into the second container 304. The liquid 300 in the second container 304 of the liquid tank 301 is returned to the main tank 201 by the liquid feed pump 207.

At this stage, the driving of the liquid feed pumps 205 and 207 is controlled so that the amount of liquid flowing into the first container 303 of the liquid tank 301 per unit time becomes larger than the amount of liquid flowing out of the second container 304 per unit time.

Thus, an amount of inflow of the liquid from the liquid inlet 311 of the liquid tank 301 per unit time is larger than an amount of outflow of the liquid from the liquid outlet 312 of the liquid tank 301 per unit time.

Further, the flow rate of the liquid 300 to be supplied from the main tank 201 to the liquid tank 301 is higher than the rate of discharge from the head 100, and the liquid 300 that has been supplied into the first container 303 and reaches beyond the partition 305 overflows into the second container 304 through the communication path 306. The overflowing liquid 300 and the liquid 300 collected from the head 100 are returned to the main tank 201 by the liquid feed pump 207.

Thus, the liquid 300 to be circulated becomes a liquid having a high specific gravity, and it becomes possible to reduce sedimentation and stir the entire system.

Further, as the liquid tank 301 is disposed at a position higher than the head 100, the pressure in the tank body 302 is reduced by the vacuum pump 209, so that the nozzle meniscus pressure at the head 100 is adjusted to a negative pressure. This prevents bubbles from easily flowing toward the head 100.

Furthermore, as the pressure in the tank body 302 is reduced, the air in the air layer 310 in the tank body 302 is not easily dissolved in the liquid 300, and thus, discharge failure of the head 100 due to a decrease in the degree of deaeration can be lowered.

Further, the air layer 310 in the tank body 302 functions as a damper that reduces sudden pressure fluctuations in the liquid tank 301 when the head 100 discharges liquid. Thus, stable discharge quality can be achieved.

As described above, with a simple configuration including the liquid tank according to the present disclosure, it is possible to supply and collect liquid to and from a circulation-type head.

Figure 3:
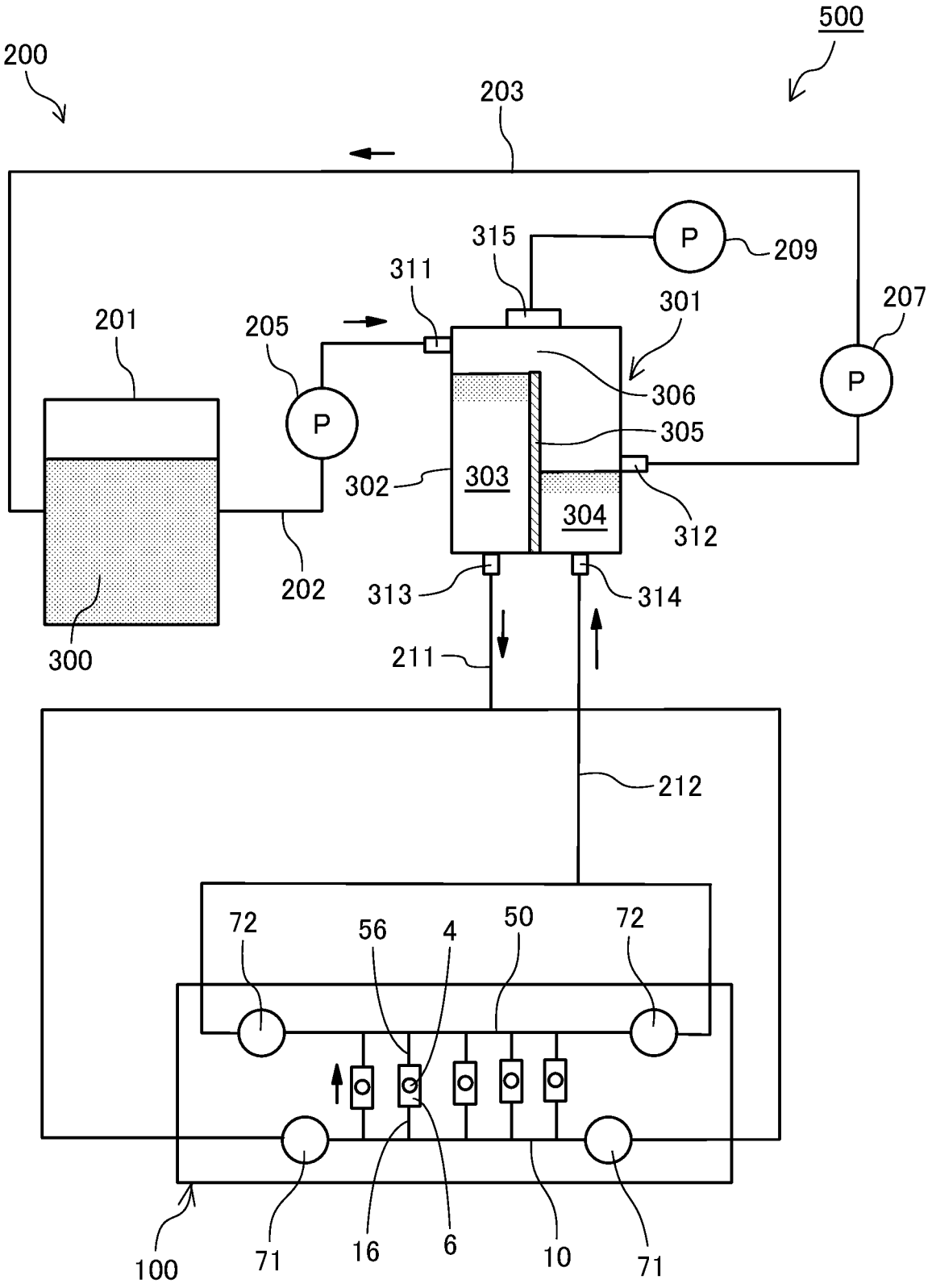
FIG. 3 is an explanatory diagram of a liquid discharge apparatus including a liquid circulation device according to a third embodiment of the present disclosure.

Referring now to FIG. 3, a third embodiment of the present disclosure is described. FIG. 3 is an explanatory diagram of a liquid discharge apparatus including a liquid circulation device according to the present embodiment.

A head 100 includes nozzles 4 that discharge liquid, pressure chambers 6 communicating with the nozzles 4, a common supply channel 10 communicating with the pressure chambers 6 via individual supply channels 16, and a common collection channel 50 communicating with the pressure chambers 6 via individual collection channels 56.

Supply ports 71 communicate with both ends of the common supply channel 10 in its longitudinal direction (nozzle array direction), and collection ports 72 communicate with both ends of the common collection channel 50 in its longitudinal direction (the nozzle array direction).

A liquid circulation device 200 includes the liquid tank 301 according to the first embodiment, and a main tank 201 that stores the liquid 300 to be supplied to the liquid tank 301. The liquid circulation device 200 further includes a liquid path 202 that connects the main tank 201 and the liquid inlet 311 of the liquid tank 301, and a liquid path 203 that connects the main tank 201 and the liquid outlet 312 of the liquid tank 301.

In the liquid path 202, a liquid feed pump 205 that is a liquid feeder is disposed. In the liquid path 203, a liquid feed pump 207 that is a liquid feeder is disposed.

The liquid tank 301 is disposed at a position higher than the head 100. The first connection port 313 of the liquid tank 301 is connected to each of the two supply ports 71 of the head 100 via a branched liquid path 211. The second connection port 314 of the liquid tank 301 is connected to each of the two collection ports 72 of the head 100 via a branched liquid path 212.

The third connection port 315 of the liquid tank 301 is connected to the vacuum pump 209 that is the depressurizing device that reduces the pressure in the tank body 302.

In the liquid circulation device 200, the liquid 300 in the main tank 201 is supplied to the first container 303 of the liquid tank 301 by the liquid feed pump 205. The liquid 300 in the first container 303 of the liquid tank 301 is supplied to the supply ports 71 of the head 100 by virtue of a water head difference.

The liquid 300 not discharged from the nozzles 4 of the head 100 then flows from the common supply channel 10 of the head 100, passes through the individual supply channels 16, the pressure chambers 6, the individual collection channels 56, and the common collection channel 50, and is collected from the collection ports 72 into the second container 304. The liquid 300 in the second container 304 of the liquid tank 301 is returned to the main tank 201 by the liquid feed pump 207.

The circulation flow rate at this stage depends on the water head difference caused by the difference in liquid level between the first container 303 and the second container 304 of the liquid tank 301.

Thus, sedimentation of the sedimentary component contained in the liquid 300 in the channels in the head 100 is reduced, so that drying of the liquid 300 can be reduced.

Figure 4:
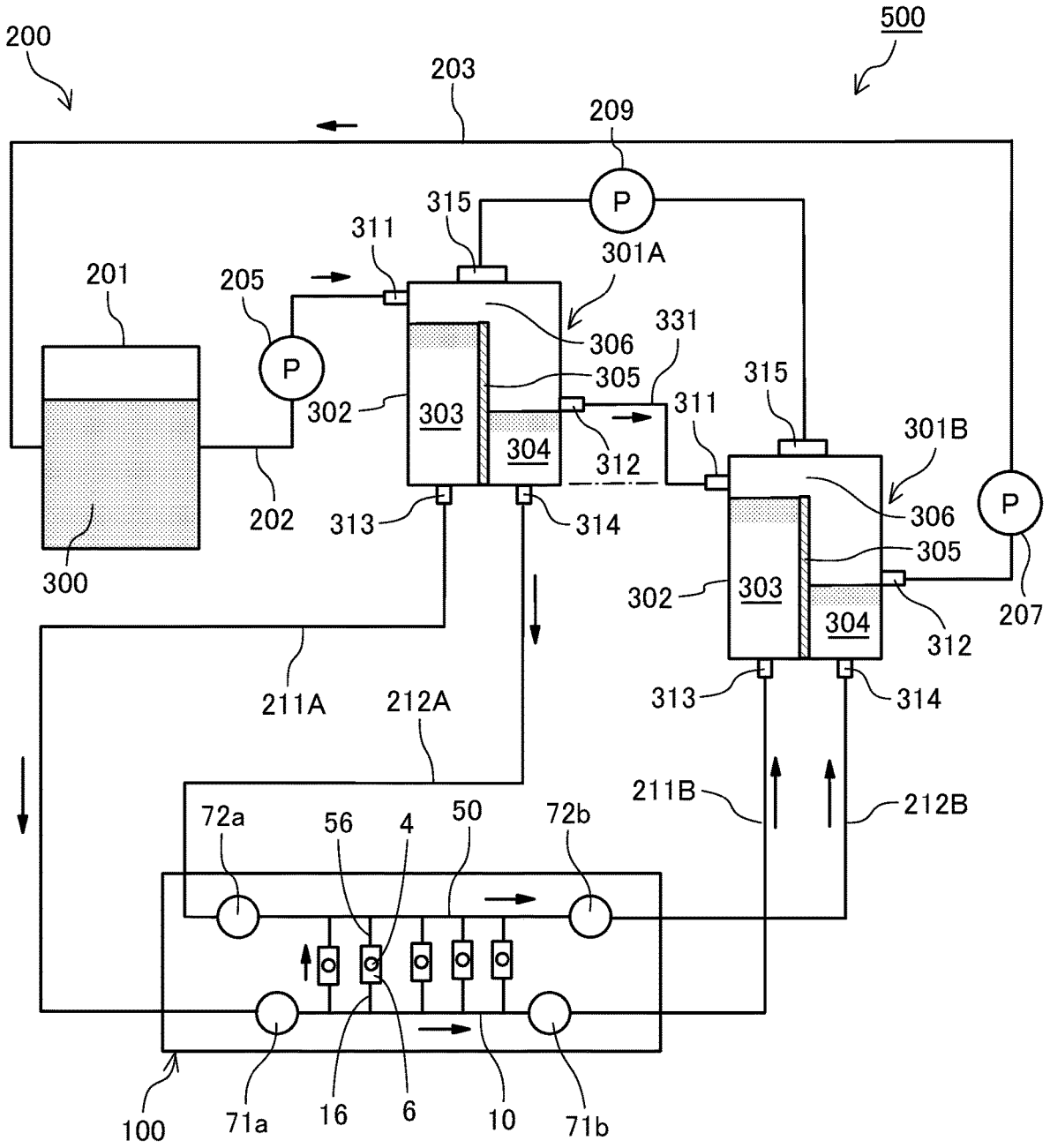
FIG. 4 is an explanatory diagram of a liquid discharge apparatus including a liquid circulation device according to a fourth embodiment of the present disclosure.

Referring now to FIG. 4, a fourth embodiment of the present disclosure is described. FIG. 4 is an explanatory diagram of a liquid discharge apparatus including a liquid circulation device according to the present embodiment.

A liquid circulation device 200 includes a plurality of (two in this example) liquid tanks 301 (301A and 301B), and is designed to supply and collect liquid to and from the same head 100.

Thus, each of the plurality of the liquid tanks 301 is connected to identical one of the plurality of the heads 100, and is disposed at a position higher than the identical one of the plurality of the heads 100. In FIG. 4, only one of the heads 100 is illustrated.

Here, both of the two liquid tanks 301 are disposed at positions higher than the head 100. Further, of the two liquid tanks 301, one liquid tank 301A (first liquid tank) is disposed at a position higher than the other liquid tank 301B (second liquid tank).

The liquid outlet 312 of the liquid tank 301A and the liquid inlet 311 of the liquid tank 301B are connected by a liquid path 331. Further, the main tank 201 and the liquid inlet 311 of the liquid tank 301A are connected by a liquid path 202, and the liquid outlet 312 of the liquid tank 301B and the main tank 201 are connected by a liquid path 203.

The first connection port 313 of the liquid tank 301A is connected to one supply port 71*a* of two supply ports 71 (71*a* and 71*b*) of the head 100 via a liquid path 211A, and the second connection port 314 of the liquid tank 301A is connected to one collection port 72*a* of two collection ports 72 (72*a* and 72*b*) of the head 100 via a liquid path 212A.

The first connection port 313 of the liquid tank 301B is connected to the other supply port 71*b* of the two supply ports 71 of the head 100 via a liquid path 211B, and the second connection port 314 of the liquid tank 301B is connected to the other collection port 72*b* of the two collection ports 72 of the head 100 via a liquid path 212B.

As the two liquid tanks 301A and 301B are arranged at different heights as described above, a water head difference is generated between the liquid level of the first container 303 of the liquid tank 301A and the liquid level of the first container 303 of the liquid tank 301B. Likewise, a water head difference is generated between the liquid level of the second container 304 of the liquid tank 301A and the liquid level of the second container 304 of the liquid tank 301B.

This causes a flow from the first container 303 of the liquid tank 301A to the first container 303 of the liquid tank 301B through the common supply channel 10 of the head 100, and a flow from the second container 304 of the liquid tank 301A to the second container 304 of the liquid tank 301B through the common collection channel 50 of the head 100.

At the same time, the liquid in the pressure chambers 6 in the head 100 flows in the pressure difference direction (toward the lower pressure side) due to the pressure difference between the common supply channel 10 and the common collection channel 50. Thus, the liquid 300 flows from the common supply channel 10 of the head 100 to the common collection channel 50 through the individual supply channels 16, the pressure chambers 6, and the individual collection channels 56.

Figure 5:
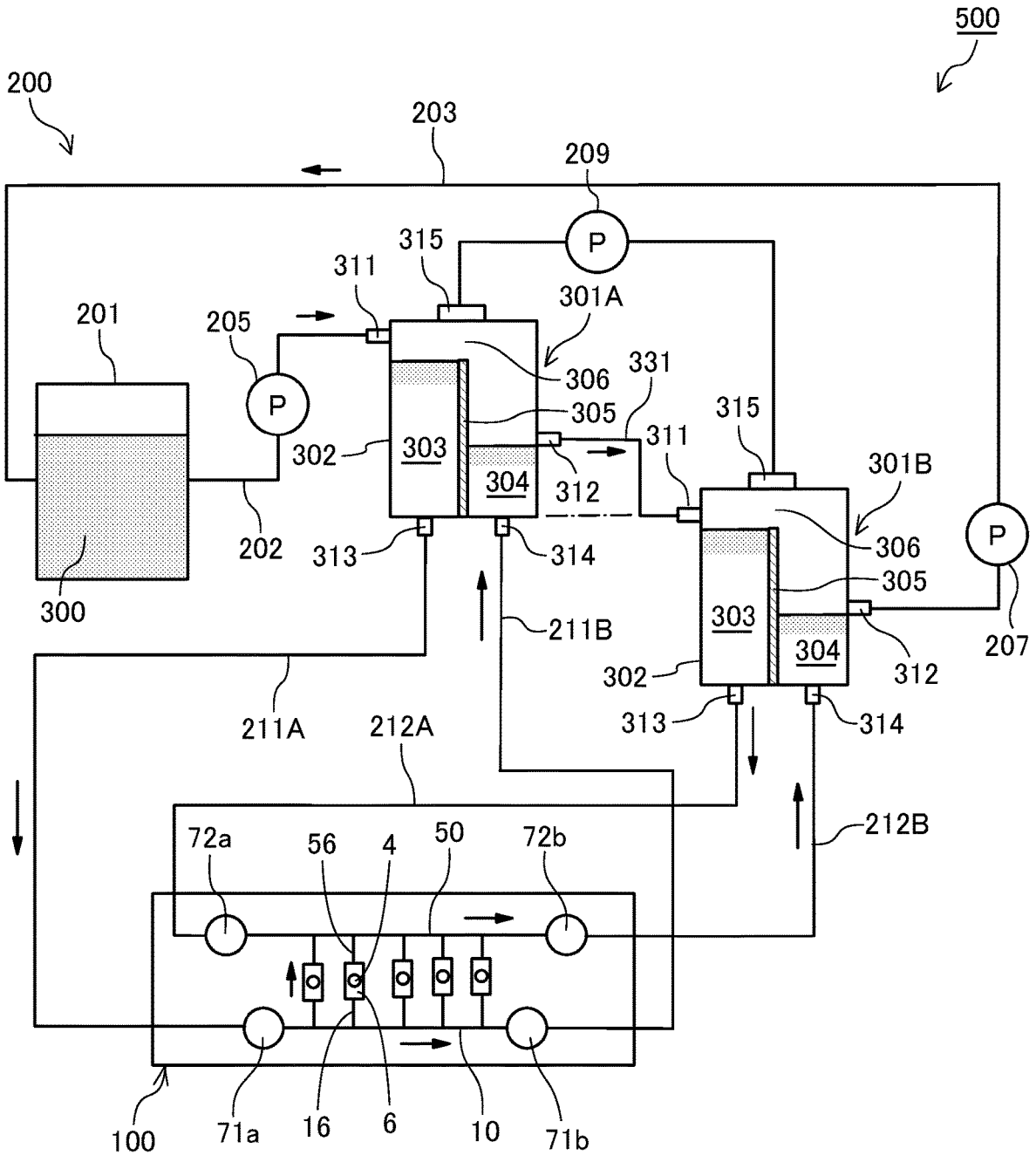
FIG. 5 is an explanatory diagram of a liquid discharge apparatus including a liquid circulation device according to a fifth embodiment of the present disclosure.

Referring now to FIG. 5, a fifth embodiment of the present disclosure is described. FIG. 5 is an explanatory diagram of a liquid discharge apparatus including a liquid circulation device according to the present embodiment.

In the present embodiment, two liquid tanks 301 (301A and 301B) are used as in the fourth embodiment, but the connection relationship between the two liquid tanks 301 and the head 100 differs from that in the fourth embodiment.

Specifically, the first connection port 313 of the liquid tank 301A is connected to one supply port 71*a* of the two supply ports 71 (71*a* and 71*b*) of the head 100 via a liquid path 211A, and the second connection port 314 of the liquid tank 301A is connected to the other supply port 71*b* of the head 100 via a liquid path 211B.

The first connection port 313 of the liquid tank 301B is connected to one collection port 72*a* of the two collection ports 72 (72*a* and 72*b*) of the head 100 via a liquid path 212A, and the second connection port 314 of the liquid tank 301B is connected to the other collection port 72*b* of the head 100.

In such a configuration, a flow from the one supply port 71*a* to the other supply port 71*b* is caused in the common supply channel 10 of the head 100 by virtue of the water head difference between the first container 303 and the second container 304 of the liquid tank 301A. Likewise, a flow from the one collection port 72*a* to the other collection port 72*b* is caused in the common collection channel 50 of the head 100 by virtue of the water head difference between the first container 303 and the second container 304 of the liquid tank 301B.

Further, a circulating flow from the common supply channel 10 to the common collection channel 50 is also caused by virtue of the water head difference between the liquid tanks 301A and 301B.

Figure 6:
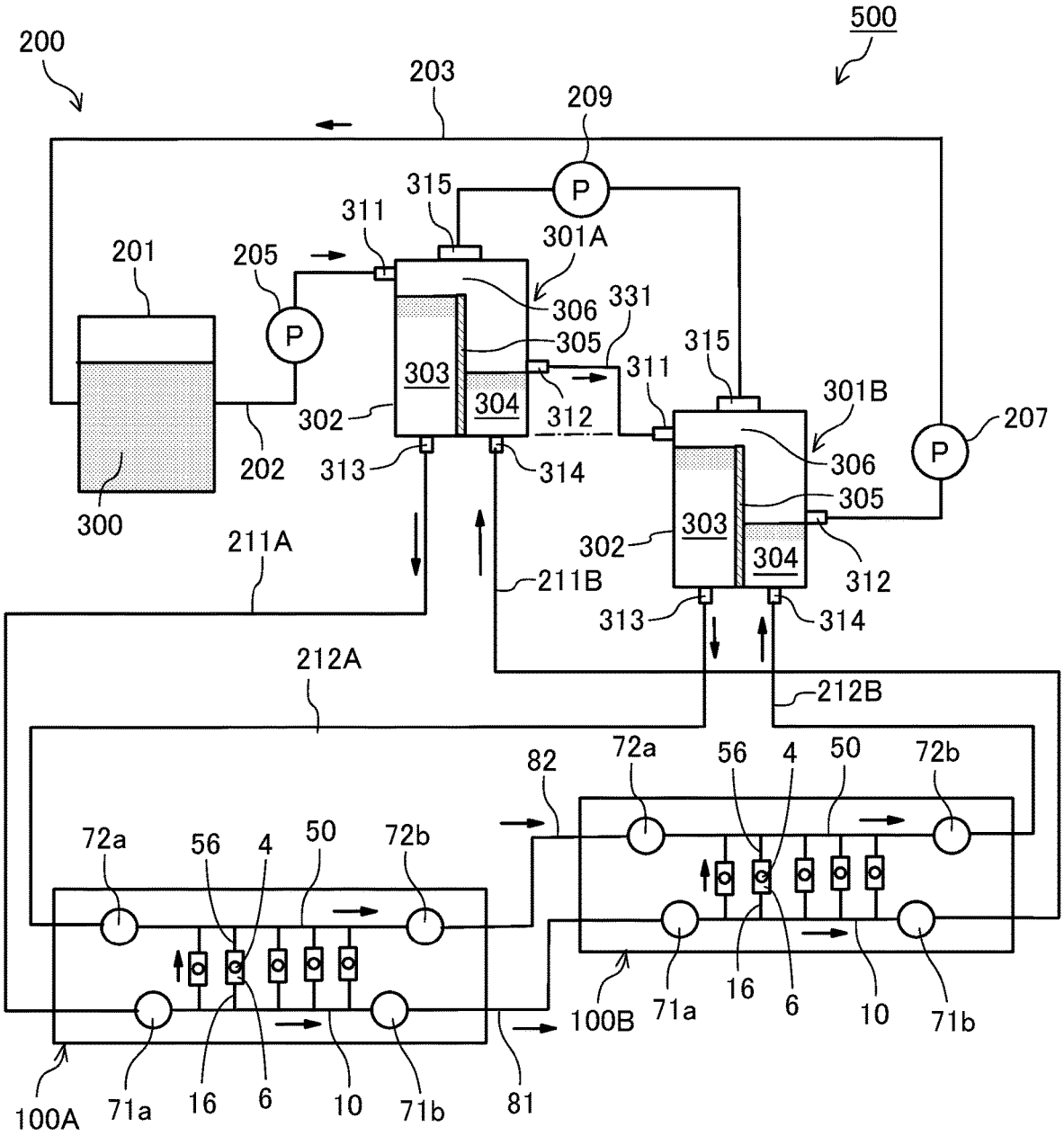
FIG. 6 is an explanatory diagram of a liquid discharge apparatus including a liquid circulation device according to a sixth embodiment of the present disclosure.

Referring now to FIG. 6, a sixth embodiment of the present disclosure is described. FIG. 6 is an explanatory diagram of a liquid discharge apparatus including a liquid circulation device according to the present embodiment.

In the present embodiment, the respective common supply channels 10 and the respective common collection channels 50 of two heads 100 (100A and 100B) are connected in series. Specifically, the supply port 71*b* of one head 100A and the supply port 71*a* of the other head 100B are connected by a liquid path 81. Further, the collection port 72*b* of the one head 100A and the collection port 72*a* of the other head 100B are connected by a liquid path 82.

A liquid circulation device 200 includes two liquid tanks 301 (301A and 301B) as in the fifth embodiment.

The first connection port 313 of the liquid tank 301A is connected to the supply port 71*a* of the head 100A via a liquid path 211A, and the second connection port 314 is connected to the supply port 71*b* of the head 100B via a liquid path 211B.

The first connection port 313 of the liquid tank 301B is connected to the collection port 72*a* of the head 100A via a liquid path 212A, and the second connection port 314 is connected to the collection port 72*b* of the head 100B via a liquid path 212B.

In the present embodiment, by virtue of the water head difference between the first container 303 and the second container 304 of the liquid tank 301A, a flow from the supply port 71*a* of the one head 100A to the supply port 71*b* of the other head 100B through the liquid path 81 is caused in the common supply channels 10 of the two heads 100.

Likewise, by virtue of the water head difference between the first container 303 and the second container 304 of the liquid tank 301B, a flow from the collection port 72*a* of the one head 100A to the collection port 72*b* of the other head 100B through the liquid path 82 is caused in the common collection channels 50 of the two heads 100.

Further, a circulating flow from the common supply channels 10 to the common collection channels 50 is also caused by virtue of the water head difference between the liquid tanks 301A and 301B.

In the above described embodiment including the two liquid tanks 301, the two liquid tanks 301A and 301B are designed to disposed at different heights, to generate a water head difference (pressure difference). However, the resistance value of the third connection port 315 connected to a vacuum pump 209 serving as the depressurizing device may be varied, to generate a pressure difference between the two liquid tanks 301A and 301B.

Figure 7:
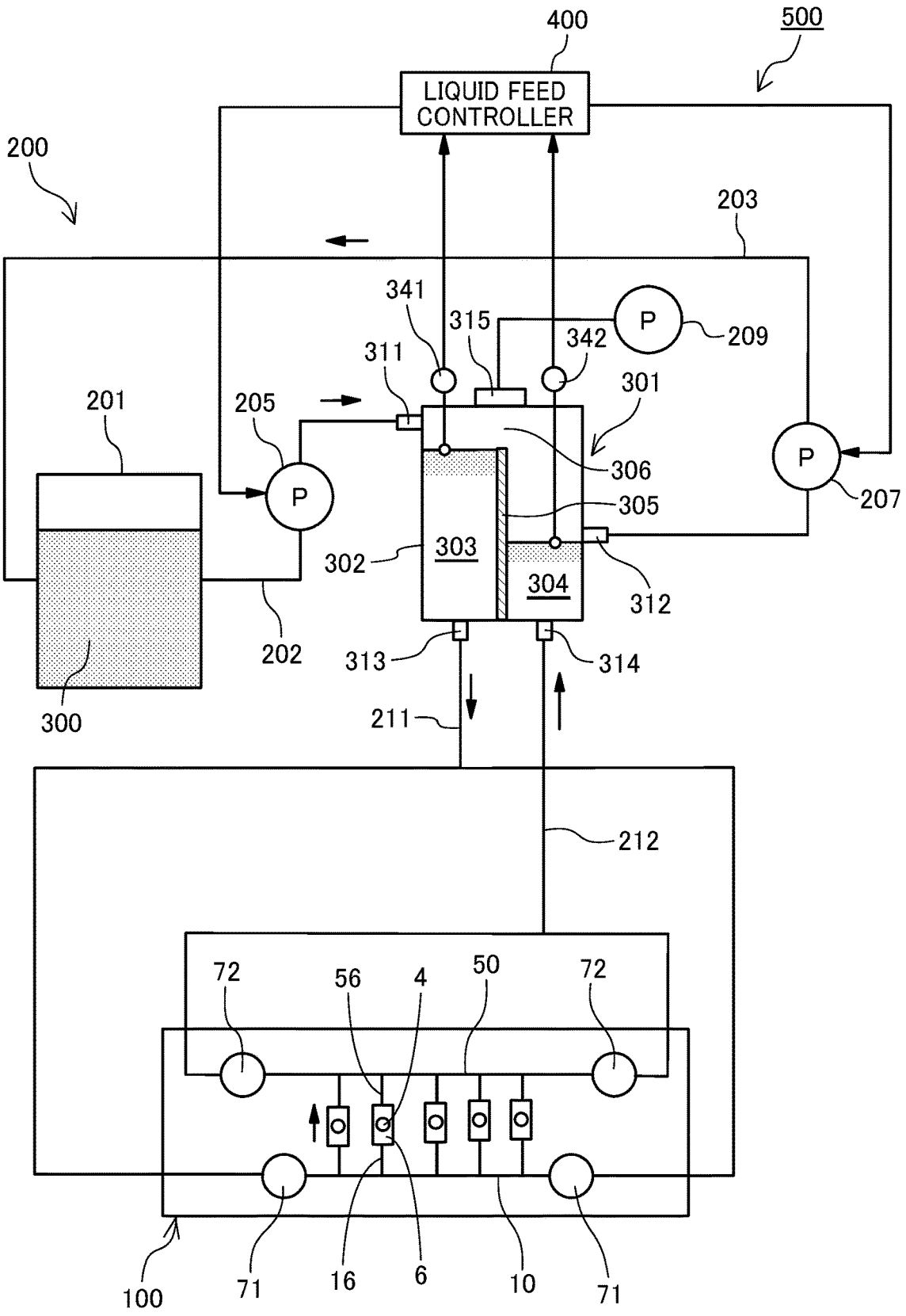
FIG. 7 is an explanatory diagram of a liquid discharge apparatus including a liquid circulation device according to a seventh embodiment of the present disclosure.

Referring now to FIG. 7, a seventh embodiment of the present disclosure is described. FIG. 7 is an explanatory diagram of a liquid discharge apparatus including a liquid circulation device according to the present embodiment.

The present embodiment has the same configuration as that of the second embodiment (or any of the other embodiments), except for further including a liquid level detector 341 that detects the liquid level of the first container 303, a liquid feed controller 400, and a liquid level detector 342 that detects the liquid level of the second container 304.

The liquid feed controller 400 controls the liquid feed pumps 205 and 207 based on readings from the liquid level detectors 341 and 342 to control an amount of liquid to be fed to the liquid tank 301 and an amount of liquid to be discharged from the liquid tank 301.

Figure 8:
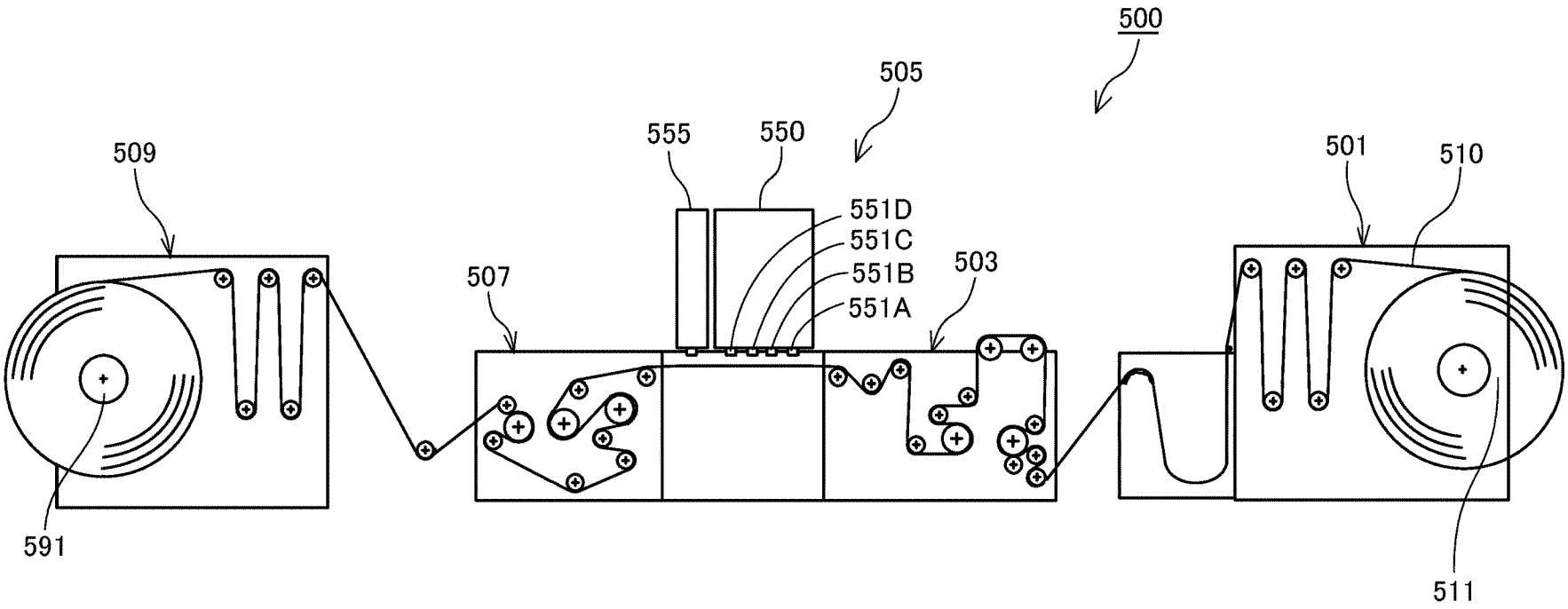
FIG. 8 is a schematic explanatory view of an example of general arrangement of a liquid discharge apparatus according to the present disclosure.
Figure 9:
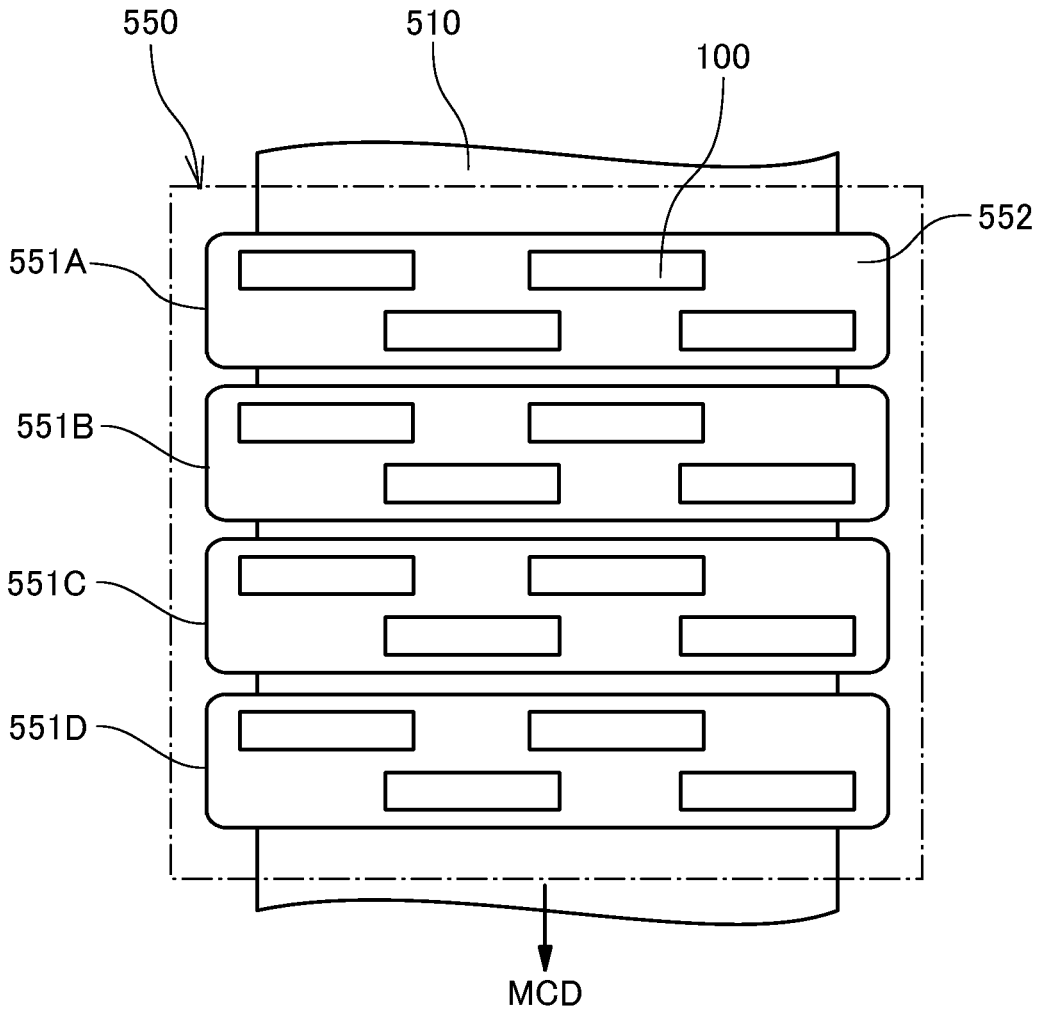
FIG. 9 is a plan explanatory view of an example of the head device of the liquid discharge apparatus.

Referring now to FIGS. 8 and 9, an example of general arrangement of a liquid discharge apparatus according to an embodiment of the present disclosure is described. FIG. 8 is a schematic explanatory view of the liquid discharge apparatus. FIG. 9 is a plan explanatory view of an example of the head device of the liquid discharge apparatus.

This liquid discharge apparatus 500 is a printing apparatus, and includes: a feeder 501 that feeds a continuous medium 510; a guide conveyor 503 that guides and conveys the continuous medium 510 fed from the feeder 501 to a printer 505; the printer 505 that performs printing to form an image by discharging liquid onto the continuous medium 510; a drier 507 that dries the continuous medium 510; and a carrier 509 that ejects the continuous medium 510.

The continuous medium 510 is sent out from a feeding roller 511 of the feeder 501, is guided and conveyed by the respective rollers of the feeder 501, the guide conveyor 503, the drier 507, and the carrier 509, and is wound up by a winding roller 591 of the carrier 509.

In the printer 505, the continuous medium 510 is conveyed while facing a head device 550 and a head device 555. An image is formed with liquid discharged from the head device 550, and post-processing is performed with a treatment liquid discharged from the head device 555.

In the head device 550, full-line head arrays 551A, 551B, 551C, and 551D for four colors (hereinafter referred to as the "head arrays 551" when the colors are not distinguished from one another) are arranged in this order from the upstream side in the conveyance direction of the continuous medium 510 indicated by arrow MCD, for example.

Each head array 551 is a liquid discharger, and discharges liquid of black K, cyan C, magenta M, or yellow Y onto the continuous medium 510 being conveyed. Note that the colors and the numbers of the colors are not limited to this example.

Each head array 551 is formed with heads 100 arranged on a base member 552 in a staggered manner, for example. However, the head arrays 551 do not necessarily have this staggered arrangement.

In this application, the liquid to be discharged is not limited to any particular liquid, as long as the liquid has such a viscosity or surface tension that the liquid can be discharged from a head. However, the viscosity of the liquid is preferably not higher than 30 mPa·s under ordinary temperature and ordinary pressure, or by heating or cooling. More specifically, the liquid may be a solution, a suspension, or an emulsion containing a solvent such as water or an organic solvent, a colorant such as a dye or a pigment, a functionalizing material such as a polymerizable compound, a resin, or a surfactant, a biocompatible material such as DNA, amino acid, protein, or calcium, an edible material such as a natural pigment, or the like. Any of these liquids can be used as an inkjet ink, a surface treatment liquid, a liquid for forming components or an electronic circuit resist pattern for electronic elements or light-emitting elements, a three-dimensional fabricating material solution, or the like.

Examples of an energy source for generating energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

A "liquid discharge unit" is formed by integrating functional components and mechanisms in a liquid discharge head, and is an assembly of components relating to liquid discharge. For example, a "liquid discharge unit" may include a combination of a liquid discharge head and at least one of a head tank, a carriage, a supply mechanism, a maintenance/recovery mechanism, a main-scanning movement mechanism, and a liquid circulation device.

Examples of the integrated structure include a combination in which a liquid discharge head, functional components, and mechanisms are secured to one another by fastening, bonding, or engaging, for example, and a combination in which one of the head and each component is movably supported by the other. Alternatively, the liquid discharge head, the functional components, and the mechanisms may be detachably attached to one another.

An example of the liquid discharge unit is a combination of a liquid discharge head and a head tank. Alternatively, the liquid discharge head and the head tank are integrally connected to each other with a tube or the like. In this case, a unit that includes a filter may be added between the head tank and the liquid discharge head of the liquid discharge unit.

Alternatively, a liquid discharge head and a carriage are integrated, to form a liquid discharge unit.

Further, an example of a liquid discharge unit is a structure in which a liquid discharge head is movably supported by a guide member that forms part of a scanning movement mechanism, and the liquid discharge head and the scanning movement mechanism are integrated. Yet another example of a liquid discharge unit is a structure in which a liquid discharge head, a carriage, and a main-scanning movement mechanism are integrated.

Another example of a liquid discharge unit is a structure in which a cap member that is part of a maintenance/recovery mechanism is secured to a carriage to which a liquid discharge head is attached, and the liquid discharge head, the carriage, and the maintenance/recovery mechanism are integrated.

Yet another example of a liquid discharge unit is a structure in which a tube is connected to a liquid discharge head to which a head tank or channel components are attached, and the liquid discharge head and a supply mechanism are integrated. Through this tube, the liquid in the liquid storage source is supplied to the liquid discharge head.

The main-scanning movement mechanism may be formed only with a guide member. The supply mechanism may be formed only with a tube or a loading member.

A "liquid discharge apparatus" may be an apparatus that includes a liquid discharge head or a liquid discharge unit, and drives the liquid discharge head to discharge liquid. The liquid discharge apparatus may be an apparatus capable of discharging liquid into air or liquid, instead of an apparatus capable of discharging liquid onto a medium to which liquid can adhere.

This "liquid discharge apparatus" may also include devices relating to feeding, conveyance, and paper ejection of a medium to which liquid can adhere, a preprocessing device, and a post-processing device.

For example, a "liquid discharge apparatus" may be an image forming apparatus that forms an image on a paper sheet by discharging ink, or a stereoscopic fabricating apparatus (a three-dimensional fabricating apparatus) that discharges a fabricating liquid onto a powder layer formed from powder, to fabricate a solid object (a three-dimensional object).

A "liquid discharge apparatus" is not necessarily an apparatus that discharges liquid to visualize meaningful images, such as characters or figures. For example, a liquid discharge apparatus may form meaningless images, such as meaningless patterns, or form three-dimensional images.

The "medium to which liquid can adhere" means a medium to which liquid can at least temporarily adhere, a medium to which liquid adheres and sticks, a medium to which liquid adheres and penetrates, or the like. Specific examples of such media include media onto which recording is performed, such as paper sheets, recording paper, recording sheets, film, and cloth, electronic boards, electronic components such as piezoelectric elements, powder layers (powdery layers), organ models, and test cells. The specific examples include all media to which liquid can adhere, unless otherwise specified.

The material of the above "medium to which liquid can adhere" should be a medium to which liquid can at least temporarily adhere, such as paper, thread, fiber, cloth, leather, metal, plastic, glass, wood, or ceramics.

Alternatively, a "liquid discharge apparatus" may be an apparatus in which a liquid discharge head and a medium to which liquid can adhere move relative to each other, but is not necessarily such an apparatus. Specific examples of such apparatuses include a serial head apparatus that moves the liquid discharge head, and a line head apparatus that does not move the liquid discharge head.

Further, a "liquid discharge apparatus" may be a treatment liquid application apparatus that discharges a treatment liquid onto a paper sheet to apply the treatment liquid onto the surface of the paper sheet and modify the surface of the paper sheet, or an injecting granulation apparatus that granulates fine particles of a raw material by spraying a composition liquid containing the raw material dispersed in a solution through a nozzle, or the like.

Note that the terms "image formation", "recording", "printing", "image printing", and "fabricating" used herein may be used synonymously with one another.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions. For example, the liquid feed controller 400 in FIG. 7 may be implemented by the processing circuit (circuitry) such as the ASIC.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid tank comprising:

a tank body configured to store a liquid to be supplied to a liquid discharge head;

a first container;

a second container;

a partition dividing an interior of the tank body into the first container and the second container;

a communication path disposed in the tank body, the communication path connecting the first container and the second container;

a liquid inlet communicating with the first container;

a liquid outlet disposed at a position lower than the communication path, the liquid outlet communicating with the second container;

a first connection port communicating with the first container, the first connection port disposed lower than the liquid inlet and configured to be connected to a supply port of the liquid discharge head; and a second connection port communicating with the second container, the second connection port disposed at a position lower than the liquid outlet and configured to be connected to a collection port of the liquid discharge head.

2. The liquid tank according to claim 1, wherein the partition vertically rises from an inner bottom surface of the tank body to a position lower than an inner top surface of the tank body and the communication path is formed between a top end of the partition and the inner top surface of the tank body.

3. The liquid tank according to claim 2, wherein the liquid inlet is disposed higher than the top end of the partition.

4. A liquid circulation device comprising:

the liquid tank according to claim 1;

a main tank storing the liquid;

a pump configured to reduce a pressure in the liquid tank; and a liquid feeder disposed in a liquid path connecting the liquid tank and the main tank.

5. The liquid circulation device according to claim 4, wherein the liquid tank is disposed higher than the liquid discharge head.

6. The liquid circulation device according to claim 4, comprising:

a plurality of liquid tanks, including the liquid tank, disposed at different heights; and a plurality of liquid discharge heads including the liquid discharge head, wherein each of the plurality of liquid tanks is connected to identical one of the plurality of liquid discharge heads, and is disposed at a position higher than the identical one of the plurality of liquid discharge heads.

7. The liquid circulation device according to claim 4, comprising:

a plurality of liquid tanks including the liquid tank; and a plurality of liquid discharge heads including the liquid discharge head, wherein each of the plurality of liquid tanks is connected to identical one of the plurality of liquid discharge heads, and is disposed at a position higher than the identical one of the plurality of liquid discharge heads, and pressures in the plurality of liquid tanks are controlled to be different from each other.

8. The liquid circulation device according to claim 4, comprising:

a plurality of liquid tanks, including the liquid tank, disposed at different heights; and a liquid path configured to connect the liquid outlet of one of the plurality of liquid tanks and the liquid inlet of another of the plurality of liquid tanks disposed lower than one of the plurality of liquid tanks.

9. The liquid circulation device according to claim 4, wherein an amount of inflow of the liquid from the liquid inlet of the liquid tank per unit time is larger than an amount of outflow of the liquid from the liquid outlet of the liquid tank per unit time.

10. The liquid circulation device according to claim 9, further comprising:

a detector configured to detect a liquid level in the liquid tank; and circuitry configured to control at least one of the amount of inflow and the amount of outflow based on readings from the detector.

11. A liquid discharge apparatus comprising:

the liquid discharge head according to claim 4 in which the liquid is flown through an interior of the liquid discharge head from the supply port to the collection port of the liquid discharge head; and the liquid circulation device according to claim 4.

* * * * *